US009976571B2

(12) United States Patent
Lee

(10) Patent No.: US 9,976,571 B2
(45) Date of Patent: May 22, 2018

(54) FAN ASSEMBLY

(71) Applicant: CLOUD NETWORK TECHNOLOGY SINGAPORE PTE. LTD., Singapore (SG)

(72) Inventor: Chia-Chen Lee, New Taipei (TW)

(73) Assignee: Cloud Network Technology Singapore Pte. Ltd., Singapore (SG)

( * ) Notice: Subject to any disclaimer, the term of this patent is extended or adjusted under 35 U.S.C. 154(b) by 171 days.

(21) Appl. No.: 14/967,963

(22) Filed: Dec. 14, 2015

(65) Prior Publication Data

US 2017/0152867 A1 Jun. 1, 2017

(30) Foreign Application Priority Data

Nov. 28, 2015 (CN) ..... 2015 1 0841094

(51) Int. Cl.
*F04D 29/64* (2006.01)
*F04D 29/66* (2006.01)
*F04D 19/00* (2006.01)

(52) U.S. Cl.
CPC ..... *F04D 29/668* (2013.01); *F04D 19/007* (2013.01); *F04D 29/646* (2013.01); *F05B 2260/964* (2013.01)

(58) Field of Classification Search
CPC ..... F04D 29/668; F04D 29/646; F04D 29/66; F04D 29/64; F04D 25/166; F04D 19/002; H05K 7/02; H05K 7/023
See application file for complete search history.

(56) References Cited

U.S. PATENT DOCUMENTS 8,075,250 B2 * 12/2011 Zhou ..... F04D 29/64 24/453
2011/0146954 A1 * 6/2011 Liu ..... H01L 23/4006 165/104.26

* cited by examiner

*Primary Examiner* — Woody Lee, Jr.
*Assistant Examiner* — Maxime Adjagbe
(74) *Attorney, Agent, or Firm* — ScienBiziP, P.C.

(57) ABSTRACT

The disclosure provides a fan assembly for connecting the first fan to the second fan. The fan assembly includes at least one fastening member. Each of the first fan and the second fan includes a first flange and a second flange and a body interconnecting the first flange and the second flange, the fastening member includes a locating column and an elastic element. The elastic element is held between the first flange of the first fan and the second flange of the second fan, the locating column passes through the elastic element, the first flange of the first fan, and the second flange of the second fan, to connect the first fan to the second fan.

13 Claims, 4 Drawing Sheets

FAN ASSEMBLY

FIELD

The subject matter herein generally relates to a fan assembly.

BACKGROUND

Two fans are connected together by screws which are rigid in nature, a vibration is easily generated between the fans.

BRIEF DESCRIPTION OF THE DRAWINGS

Implementations of the present technology will now be described, by way of example only, with reference to the attached figures.

DETAILED DESCRIPTION

Figure 1:
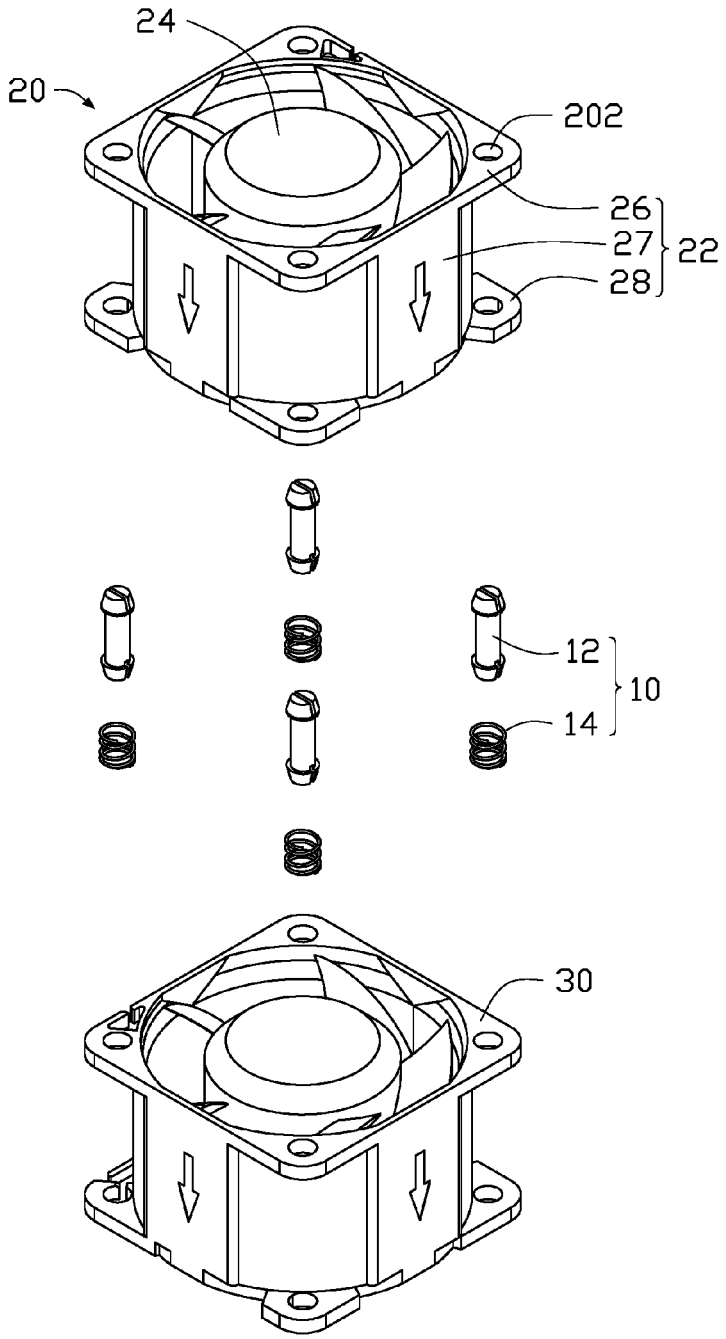
FIG. 1 is an unassembled, isometric view of a first embodiment of a connecting assembly with a fastening device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 illustrates a fan assembly of the present disclosure. The fan assembly in accordance with an exemplary embodiment can comprise a first fan 20, a second fan 30, and a plurality of fastening members 10. Each fastening member 10 is configured for connecting the first fan 20 with the second fan 30. The first fan 20 and the second fan 30 are axial fans and have the same size and shape. Each first fan 20 and second fan 30 comprises a hollow frame 22 and an impeller 24 received in a center of the frame 22. The frame 22 comprises a cylindrical body 27, an upper flange 26 and a lower flange 28 respectively extending outwardly and horizontally from a circumferential periphery of a top and a bottom of the cylindrical body 27. The upper flange 26 and lower flange 28 each define four mounting holes 202 in four corners.

Figure 2:
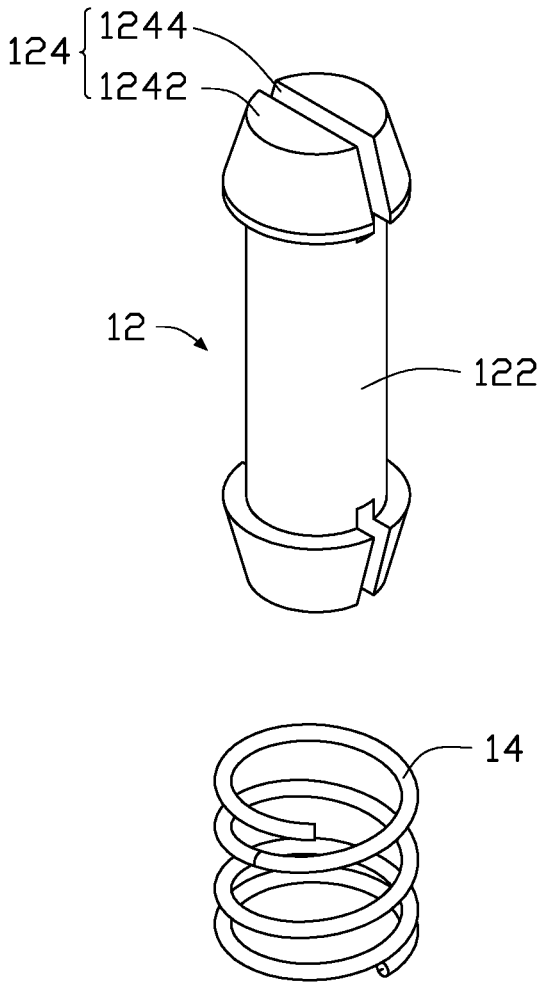
FIG. 2 is an enlarged view of the fastening device of FIG. 1.

FIG. 2 illustrates that the fastening member 10 comprises a locating column 12 and an elastic element 14. The elastic element 14 is installed on the locating column 12. The locating column 12 can comprise a supporting portion 122 and two elastic portions 124 respectively extending perpendicularly and oppositely from central portions of top and bottom surfaces of the supporting portion 122.

The elastic portions 124 of the locating column 12 has a diameter larger than the mounting hole 202 of the first and second fans 20, 30. The elastic element 14 is placed between a bottom face of the lower flange 28 of the first fan 20 and a top face of the upper flange 26 of the second fan 30, whereby the first fan 20 and second fan 30 are separated from each other and resiliently supported by the elastic element 14. A vibration generated between the first fan 20 and second fan 30, when the first fan 20 and second fan 30 are in operation, is prevented by the present disclosure.

In the illustrated embodiment, the elastic element 14 is a spring.

Each elastic portion 124 comprises two spaced flexible arms 1242. A slot 1244 is defined between the two flexible arms 1242 for providing a deforming space for the two flexible arms 1242. The two flexible arms 1242 of each elastic portion 124 can be deformed toward each other in the slot 1244 when being inserted into a corresponding mounting hole 202 of the first fan 20 and second fan 30.

Figure 3:
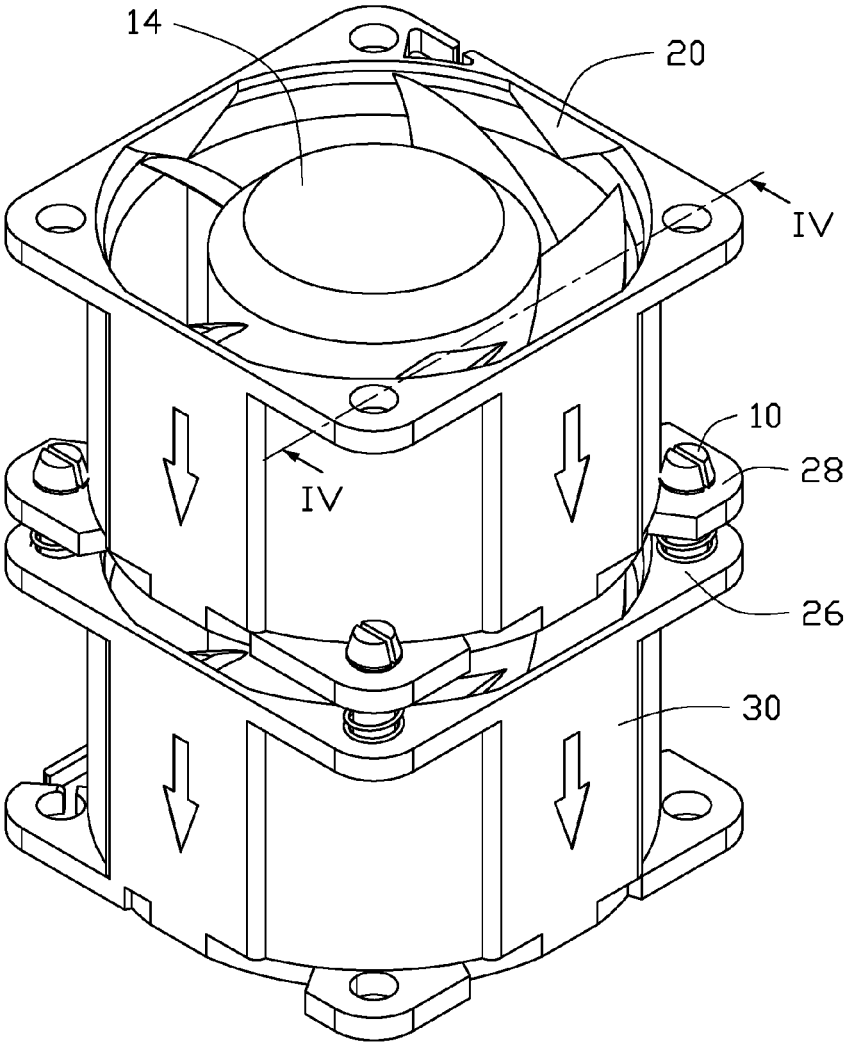
FIG. 3 is an assembled, isometric view of the fan assembly of FIG. 1.
Figure 4:
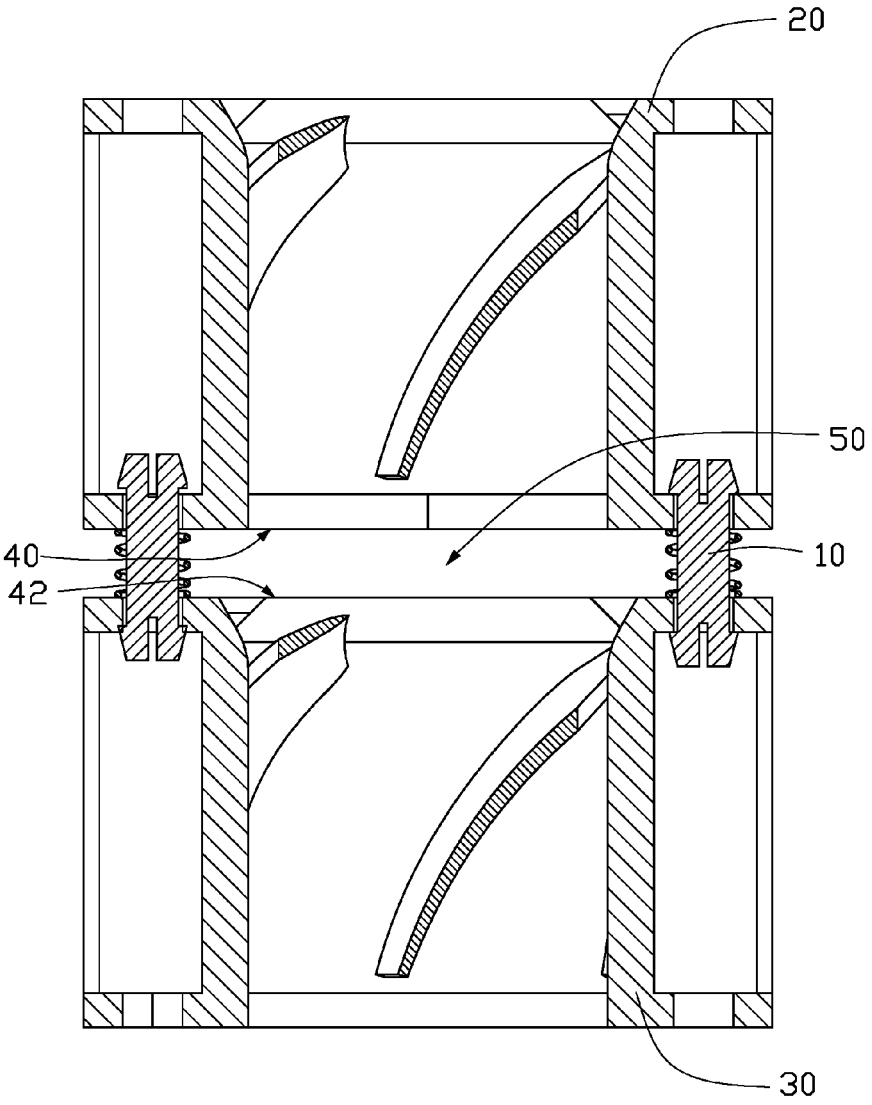
FIG. 4 is a cross sectional view of the fan assembly, taken along a line IV-IV of FIG. 3.

FIGS. 3 and 4 illustrate that both the bottom surface of the lower flange 28 of the first fan 20 and the bottom surface of the first fan 20 are in a same first plane 40. Both the top surface of the upper flange 26 of the second fan 30 and the top surface of the second fan 30 are in a same second plane 42. A gap 50 is defined between the first plane 40 and the second plane 42, to increase the area of the air flowing into the first fan 20 and the second fan 30. Thus, the vibration and noise generated by the first fan 20 and the second fan 30 can be reduced within a certain range.

During assembly, the elastic element 14 is installed on the locating column 12, and a top end of each fastening member 10 is brought to extend through the corresponding mounting hole 202 of the lower flange 28 of the first fan 20. The elastic portion 124 is deformed inwardly to make the flexible arms 1242 pass through the mounting hole 202 of the lower flange 28 of the first fan 20. After the elastic portion 124 is substantially inserted into the mounting hole 202 of the lower flange 28 of the first fan 20, the flexible arms 1242 are released outwardly to their original positions. At the meantime, the elastic portion 124 is held in the top surface of the lower flange 28 of the first fan 20.

A bottom end of each fastening member 10 is brought to extend through the corresponding mounting hole 202 of the upper flange 26 of the second fan 30. The elastic portion 124 is deformed inwardly to make the flexible arms 1242 pass through the mounting hole 202 of the upper flange 26 of the second fan 30. After the elastic portion 124 is substantially inserted into the mounting hole 202 of the upper flange 26 of the second fan 30, the flexible arms 1242 are released outwardly to their original positions. At the meantime, the elastic portion 124 is held in the bottom surface of the upper flange 26 of the second fan 30. In this position, the elastic element 14 is held between the first fan 20 and the second fan 30. Thus, the first fan 20 and second fan 30 are firmly connected together.

Even though numerous characteristics and advantages of the embodiments have been set forth in the foregoing description, together with details of the structure and function of the embodiments, the present disclosure is illustrative only, and changes may be made in details, including in the matters of shape, size, and arrangement of parts within the principles of the embodiments to the full extent indicated by the broad general meaning of the terms in which the appended claims are expressed.

What is claimed is:

1. A fan assembly comprising:

a first fan and a second fan; and a fastening member configured for fixing the first fan and the second fan together;

wherein each of the first fan and the second fan comprises a lower flange and a upper flange and a body interconnecting the lower flange and the upper flange, the fastening member comprises a locating column and a spring; and wherein the spring is held between the lower flange of the first fan and the upper flange of the second fan, the locating column passing through each of the spring, the lower flange of the first fan, and the upper flange of the second fan, to connect the first fan to the second fan.

2. The fan assembly of claim 1, wherein both a bottom surface of the lower flange of the first fan and a bottom surface of the first fan are in a same first plane.

3. The fan assembly of claim 2, wherein a top surface of the upper flange of the second fan and a top surface of the second fan are in a same second plane.

4. The fan assembly of claim 3, wherein a gap is defined between the first plane and the second plane, to increase the area of the air flowing into the first fan and the second fan.

5. The fan assembly of claim 1, wherein the locating column comprises a supporting portion and two elastic portions respectively extending perpendicularly and oppositely from central portions of top and bottom surfaces of the supporting portion, the spring is held between the lower flange of the first fan and the upper flange of the second fan by the elastic portion.

6. The fan assembly of claim 5, wherein each of the lower flange and the upper flange of the first fan and the second fan defines a mounting hole, a diameter of the elastic portion is larger than a diameter of the mounting hole.

7. The fan assembly of claim 6, wherein each elastic portion comprises two spaced flexible arms, the two flexible arms of each elastic portion can be deformed toward each other when being inserted into a corresponding mounting hole of the first fan and second fan.

8. The fan assembly of claim 7, wherein a slot is defined between the two flexible arms for providing a deforming space to the two flexible arms.

9. A fan assembly comprising:

a first fan and a second fan; and a fastening member, configured for fixing the first fan and the second fan together;

wherein each of the first fan and the second fan comprises a lower flange and a upper flange and a body interconnecting the lower flange and the upper flange, the fastening member comprises a locating column and a spring;

wherein the elastic element is held between the lower flange of the first fan and the upper flange of the second fan, the locating column passing through each of the spring, the lower flange of the first fan, and the upper flange of the second fan, to connect the first fan to the second fan; and wherein both a bottom surface of the lower flange of the first fan and a bottom surface of the first fan are in a same first plane, a top surface of the upper flange of the second fan and a top surface of the second fan are in a same second plane, and a gap is defined between the first plane and the second plane, to increase the area of the air flowing into the first fan and the second fan.

10. The fan assembly of claim 9, wherein the locating column comprises a supporting portion and two elastic portions respectively extending perpendicularly and oppositely from central portions of top and bottom surfaces of the supporting portion, the spring is held between the lower flange of the first fan and the upper flange of the second fan by the elastic portion.

11. The fan assembly of claim 10, wherein each of the lower flange and the upper flange of the first fan and the second fan defines a mounting hole, a diameter of the elastic portion is larger than a diameter of the mounting hole.

12. The fan assembly of claim 11, wherein each elastic portion comprises two spaced flexible arms, the two flexible arms of each elastic portion can be deformed toward each other when being inserted into a corresponding mounting hole of the first fan and second fan.

13. The fan assembly of claim 12, wherein a slot is defined between the two flexible arms for providing a deforming space to the two flexible arms.

* * * * *